US006411189B1

(12) United States Patent
Noda et al.

(10) Patent No.: US 6,411,189 B1
(45) Date of Patent: Jun. 25, 2002

(54) STRUCTURE OF SPOOL OF ELECTROMAGNETIC RELAY

(75) Inventors: Masayuki Noda, Kyoto; Hiroshi Iketani, Iida, both of (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 09/928,456

(22) Filed: Aug. 14, 2001

(51) Int. Cl.[7] ..... H01F 15/10
(52) U.S. Cl. ..... 336/192
(58) Field of Search ..... 335/202, 282, 335/299; 336/192, 198, 208

(56) References Cited

U.S. PATENT DOCUMENTS 3,230,489 A * 1/1966 Weyrich ..... 242/125.1
3,581,260 A * 5/1971 Andreis ..... 335/297
5,426,410 A * 6/1995 Nimi ..... 29/602.1
5,673,013 A * 9/1997 Moody et al. ..... 336/192
5,774,036 A * 6/1998 Hrytzak et al. ..... 336/185
5,952,908 A * 9/1999 Kubo ..... 29/602.1
6,005,465 A * 12/1999 Kronenberg et al. ..... 336/192
6,181,230 B1 * 1/2001 Broome et al. ..... 336/192

OTHER PUBLICATIONS

Omron, "New G8PT Power Relay Offers An Expanded Product Offering with More Standard Features" Sep. 2000 pp. 1–5.
Omron, "Power PCB Relay" Aug. 2000 p. 2.

* cited by examiner

*Primary Examiner*—Ramon M. Barrera
(74) *Attorney, Agent, or Firm*—Morrison & Foerster LLP

(57) ABSTRACT

An inward surface of a flange 12 is formed with at least two coil guide grooves 14, 15 for start-up of coil winding, which grooves are in point symmetrical with respect to the central axis of a body 11 so that they are individually positioned between coil terminal holes 12*a*, 12*b*.

1 Claim, 5 Drawing Sheets

STRUCTURE OF SPOOL OF ELECTROMAGNETIC RELAY

FIELD OF THE INVENTION

The present invention relates to a spool structure assembled to an electromagnetic relay.

BACKGROUND OF THE INVENTION

Heretofore, when disposing an electromagnetic relay, in particular an electromagnetic relay that makes and brakes an electric current having a high capacity on a printed wiring board or a mounting plate within a device, for example, the following three methods are conceived as a method of connecting coil terminals and contact terminals of the electromagnetic relay.

As the first method, a method is exemplified in which connection between coil terminals and a coil-driving circuit, and connection between contact terminals and a load such as a motor or a solenoid are provided by connecting the respective terminals to a wiring pattern on a printed circuit board.

As the second method, a method is exemplified in which the connection between coil terminals and a coil-driving circuit is provided by connecting these portions to a wiring pattern on a printed circuit board, while the connection between contact terminals and a load such as a motor or a solenoid is provided by an electric wire via tab terminal portions extended from the contact terminals.

As the third method, a method is exemplified in which the connection between coil terminals and a coil-driving circuit, and the connection between contact terminals and a load such as a motor or a solenoid are provided by an electric wire via tab terminal portions extended from the respective terminals.

However, if the connection is attempted by any one of the above methods, positions of the coil terminals and the contact terminals, which are protruded from a housing of the electromagnetic relay, are individually different from one another. Therefore, even among those electromagnetic relays having the same function and performance, the following three types of electromagnets had to be produced separately as the electromagnet to be built in.

That is, for the first method, the coil terminals and the contact terminals require being protruded from the same surface of the housing that is in contact with the printed wiring board.

Further, for the second method, the coil terminals require being protruded from a bottom surface of the housing that is in contact with the printed wiring board, while the tab terminal portions of the contact terminals require being protruded from a ceiling surface positioned on the opposite side from the bottom surface.

Furthermore, for t he third method, the tab terminal portions of the coil terminals an d the contact terminals require being protruded from a surface positioned on the opposite side from the surface on which an electromagnetic relay is mounted.

As mentioned above, if the terminals protrude in different directions, positions of twining portions of the coil terminals are individually different and therefore positions of guide grooves required at the time of coil winding are different. For this r reason , various types of spools of different shapes had to be prepared depending on the positions of the twining portions.

As one example of the spools, for example, as shown in FIG. 10, there is a spool 1 both end portions of which body

2 are formed with flanges 3, 4 that are asymmetrical shapes. The flange 3 is provided with a pair of terminal holes 5, 6 in parallel, which holes are used for press fitting coil terminals (not shown) from the lower side so as to protrude their twining portions from an upper end surface of the flange. An inward surface of the flange 3 is formed with a coil guide groove 7 to be used during the start of a coil winding process.

In particular, among high capacity-use electromagnetic relays, there is the one having a structure in which a flange 4 on one side of a spool 1 is formed with a fixed contact terminal-use holding portion (not shown). Therefore, the above spool has a complicated shape, and its mold is expensive because of this.

Accordingly, preparing various types of spools depending on different connection methods not only makes inventory control of the spools complicated but also requires various types of molds. Thus, there was a problem in that neither cost required for investment in molds nor production cost can be reduced.

An object of the present invention is to provide a spool structure for an electromagnetic relay which is easy in inventory control and low in production cost and high in production efficiency as well as productivity.

SUMMARY OF THE INVENTION

The spool structure for an electromagnetic relay according to the present invention comprises a body, and flanges respectively formed on both end portions of the body, the one side flange being provided with at least two coil terminal holes that permit coil terminals to be press fitted and also permit their twining portions to be protruded, while the other side flange being integrally formed with a fixed contact terminal-use holding part; wherein an inward surface of the one side flange is formed with at least two coil guide grooves for start-up of coil winding, which grooves are in point symmetrical with respect to the central axis of the body so that they are individually positioned between the coil terminal holes.

According to the present invention, even in the case where coil terminals of different shapes are press-fitted into coil terminal holes so as to protrude their twining portions from different directions, the coil guide grooves are so formed as to cope with any of the twining portions. Therefore, even if coil terminals require being assembled from different directions, it is possible to form different types of electromagnetic relays with one type of spool. As a result, the spool can be shared and the number of types of components to be controlled is reduced, which makes inventory control easy.

Further, it is not necessary to produce a plurality of expensive molds to form spools. This makes it possible to reduce production cost.

Furthermore, since spools of the same shape can be used even for different types of electromagnetic relays, it becomes unnecessary to change a setting of an automatic winding machine, which makes it possible to obtain an electromagnetic relay that is high in production efficiency.

Since the spools molded by one type of mold are used, variations in the dimension of components become small compared with conventional products. For this reason, adjustment work in assembling a component such as a yoke to the spool becomes unnecessary, which achieves an effect of improvement in productivity.

DETAILED DESCRIPTION OF THE PREFERRED EMBODIMENTS

An electromagnetic relay according to an embodiment of the present invention is explained with reference to the accompanying drawings FIGS. 1–9.

Figure 8:
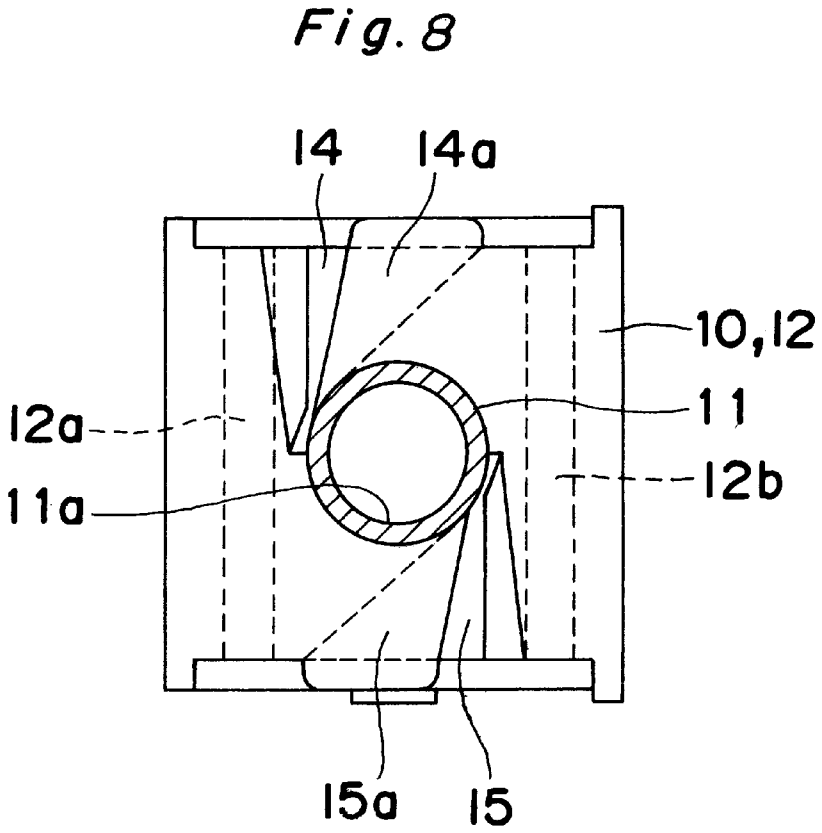
FIG. 8 is a sectional view taken on line VIII—VIII in FIG. 7.
Figure 7:
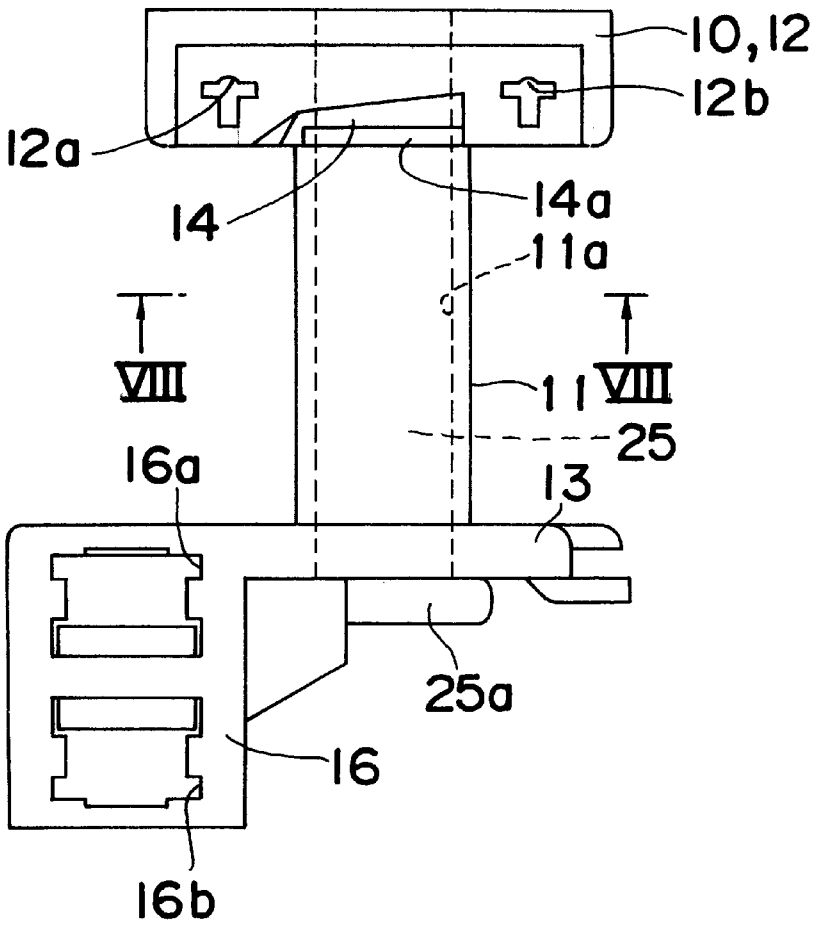
FIG. 7 is a plan view to be used for the above embodiment.
Figure 9:
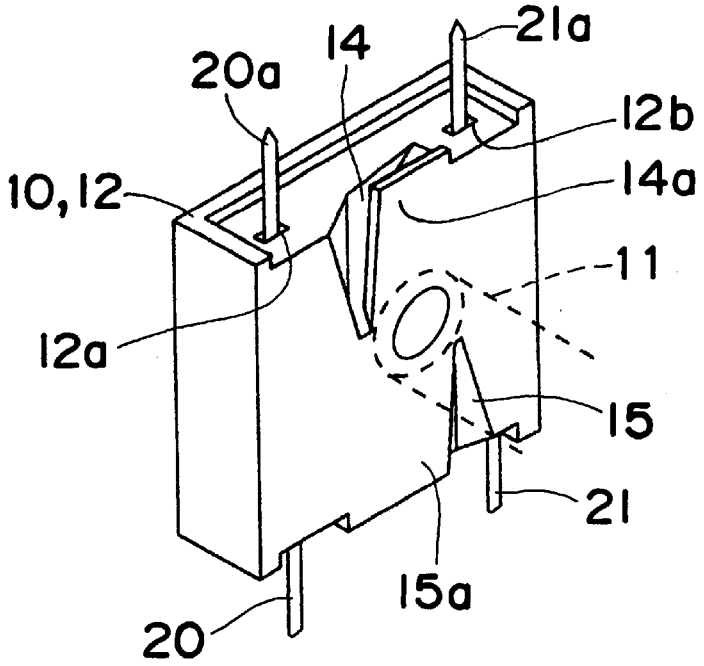
FIG. 9 is a perspective view showing one side flange portion of the spool shown in FIG. 1.
Figure 10:
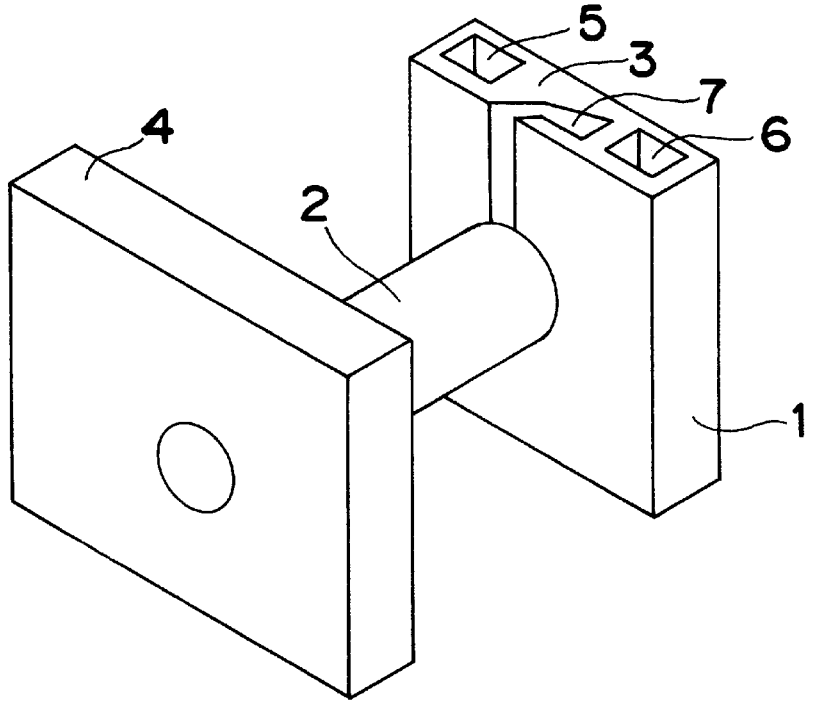
FIG. 10 is a perspective view showing a spool according to a prior art example.

As shown in FIGS. 7–9, an electromagnetic relay of the present embodiment comprises a spool 10, both end portions of which body 11 is formed with flanges 12, 13.

That is, the flange 12 on one side of the spool 10 is provided with a pair of terminal holes 12*a*, 12*b* in parallel. The terminal holes 12*a*, 12*b* have a shape which permits coil terminals 20, 21 to be press-fitted from the lower side (FIG. 9) so as to protrude twining portions 22*a*, 23*a* that are upper end portions of the coil terminals 20, 21. Further, the coil terminal holes 12*a*, 12*b* have a shape which permits tabbed coil terminals 22, 23 described later to be press-fitted from the upper side so as to protrude twining portions 22*a*, 23*a* that are lower end portions of the coil terminals 22, 23 (in FIG. 5, the twining portion 23*a* is not shown). Further, an inward surface of the flange 12 is formed with a pair of coil-use guide grooves 14, 15 in the up-and-down direction. The guide grooves 14, 15 are in point symmetrical with respect to the central axis of the body 11. The guide grooves 14, 15 are partitioned by insulating walls 14*a*, 15*a*.

On the other hand, a holding part 16 that forms a contact mechanism extends from the remaining flange 13 of the spool 10.

Accordingly, a pair of the coil terminals 20, 21 are press-fitted into the coil terminal holes 12*a*, 12*b* of the flange 12 from the lower side so as to protrude the twining portions 20*a*, 21*a* (FIG. 9). After one end portion of a coil 24 is twined around the one side twining portion 21*a*, the coil is led along the guide groove 14 to the body 11 so as to be wound on the body 11. At the end of the coil winding, the coil 24 is twined around the remaining twining portion 20*a* followed by cutting. Then, after the twining portions 20*a*, 21*a* are soldered by dipping them in a solder bath, they are bent toward the coil 24 side thereby completing coil-winding work.

Figure 1:
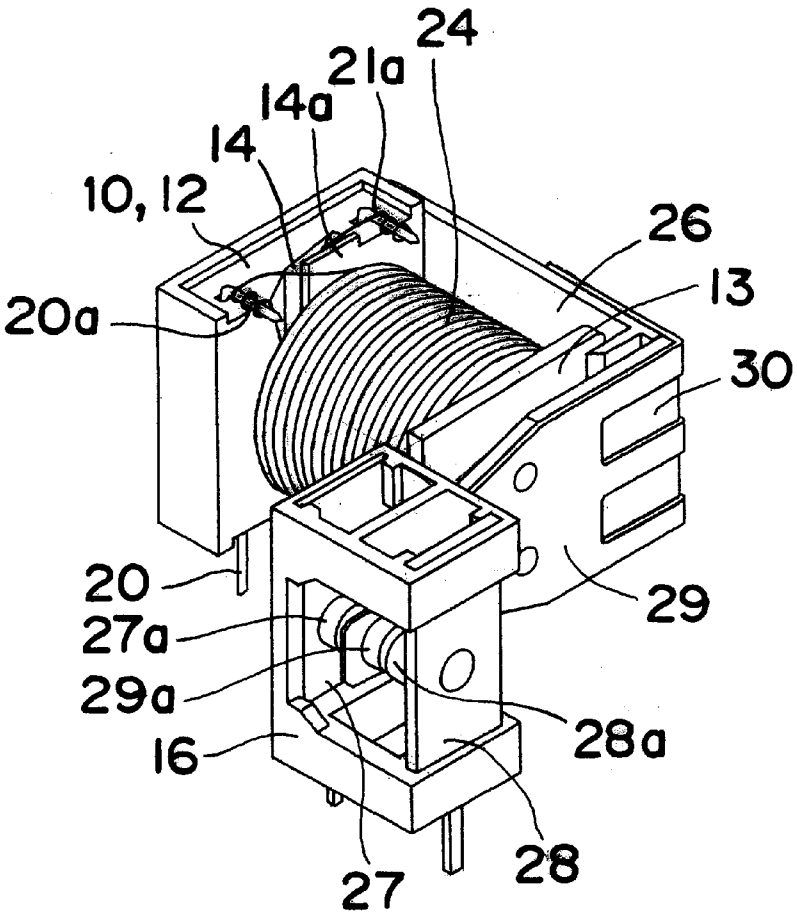
FIG. 1 is a perspective view showing an embodiment of an electromagnetic relay according to the present invention.

Next, one end portion of an iron core 25 that is roughly T-shaped in its cross section is inserted into a central hole 11*a* of the body 11 of the spool 10 (FIG. 7) and then the protruded one end portion is fixed to a yoke 26 in a caulking manner, which yoke is roughly L-shaped in its cross section (FIG. 1). On the other hand, the remaining other end portion of the iron core 25 serves as a magnetic pole portion 25. Further, a lower side edge portion of the yoke 26 is protrusively and downwardly provided with a printed circuit wiring board-use terminal portion (not shown).

On the other hand, a pair of fixed contact terminals 27, 28 are press-fitted from the upper side into terminal holes 16*a*, 16*b* (FIG. 7) formed in the holding part 16 of the spool 10, whereby fixed contacts 27*a*, 28*a* are opposed to each other at a predetermined interval.

Next, a movable spring 29 with its one end portion provided with a movable contact 29*a*, which spring is roughly L-shaped in its cross section, is fixed to one side surface of a movable iron piece 30 in a caulking manner. After that, the movable contact 29*a* is inserted between the fixed contacts 27*a*, 28*a* for positioning, while the movable iron piece 30 is positioned at a tip end edge portion of the yoke 26, and then the other end portion of the movable spring 29 is fixed to an outward surface of the yoke 26 in a caulking manner. As a result, the movable contact 29*a* is opposed to the fixed contacts 27*a*, 28*a* so as to be able to come in and out of contact with them alternately.

Therefore, according to the electromagnetic relay of the present embodiment, when a voltage is not applied to the coil 24, the movable contact 29*a* is in contact with the fixed contact 28*a* by spring force of the movable spring 29.

When the coil 24 is excited by applying a voltage thereto, the magnetic pole portion 25*a* of the movable iron core 25 attracts the movable iron piece 30. For this reason, the movable iron piece 30 pivots against the spring force of the movable spring 29. After separated from the fixed contact 28*a*, the movable contact 29*a* comes in contact with the fixed contact 27*a*, whereby the movable iron piece 30 is attracted to the magnetic pole portion 25*a*.

Then, when the application of the voltage to the coil 24 is stopped to cancel the excitation, the movable iron piece 30 pivots in the opposite direction to the previously mentioned direction by the spring force of the movable spring 29. Thus, the movable contact 29*a* is switched from the fixed contact 27*a* to the fixed contact 28*a* so as to be restored to the original state.

Figure 2:
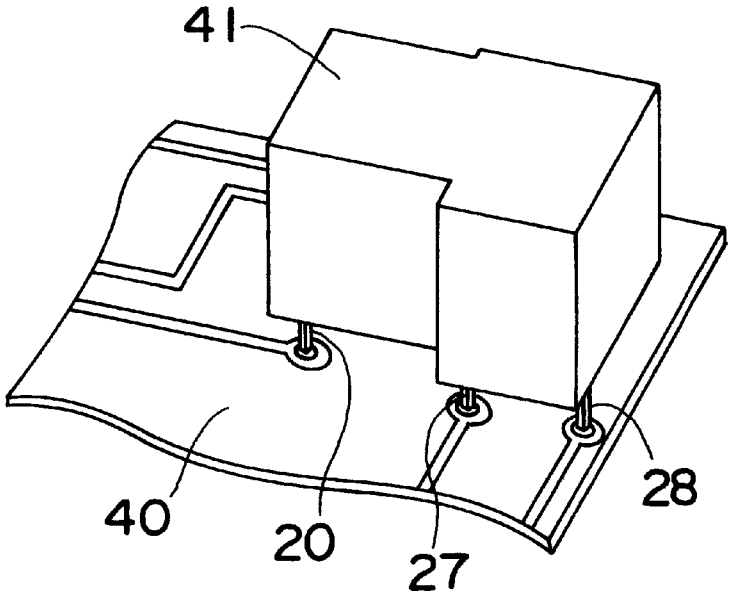
FIG. 2 is a schematic perspective view showing a connection method in the embodiment shown in FIG. 1.

In the present embodiment, as shown in FIG. 2, after the spool 10 is fixed in a case 41, terminal portions of the coil terminals 20, 21, a terminal portion of the yoke 26, and terminal portions of the fixed contact 27, 28 are respectively inserted into a printed wiring board 40 so as to be electrically connected.

Figure 3:
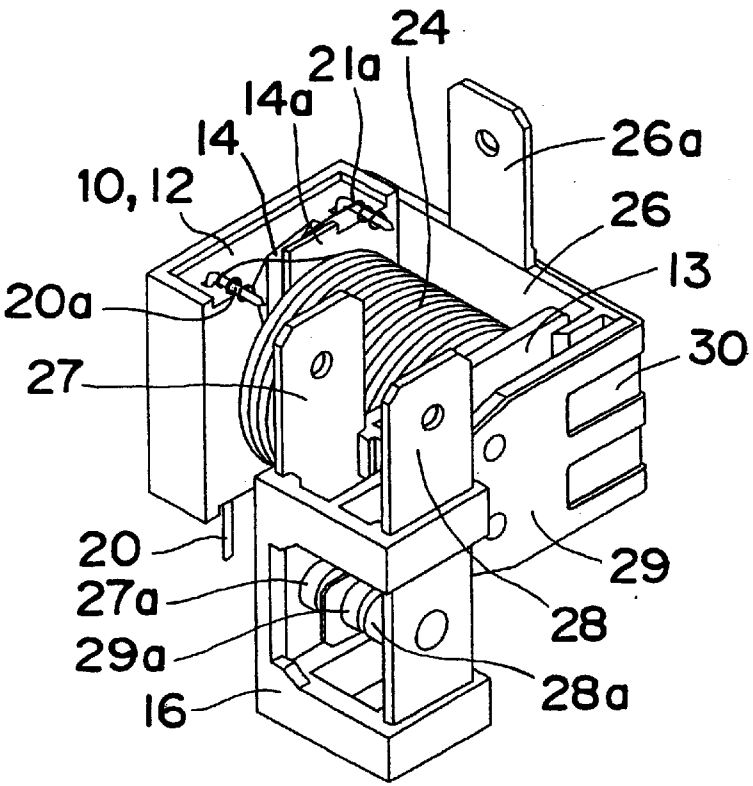
FIG. 3 is a perspective view showing an applied example of the embodiment according to the present invention.

FIG. 3 illustrates an applied example of the present embodiment. The basic constitution is almost the same as that of the above-mentioned embodiment. The difference between the present embodiment and the applied embodiment is that the yoke 26 is protrusively provided with a tab terminal portion 26*a* in place of the printed wiring board-use terminal portion and that tabbed fixed contact terminals 27, 28 are press-fitted into the terminal holes 16*a*, 16*b* of the holding part 16 from the upper side.

Figure 4:
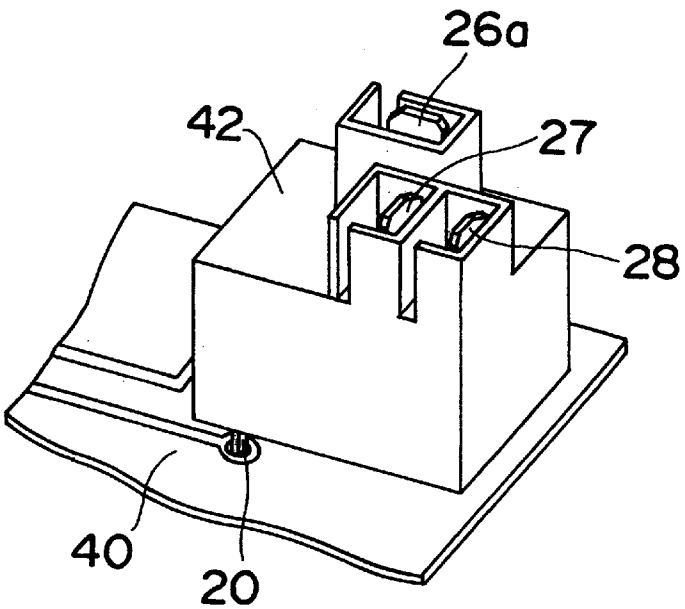
FIG. 4 is a schematic perspective view showing a connection method in the applied example shown in FIG. 3.

In the applied example of the present embodiment, for example, as shown in FIG. 4, terminal portions of the coil terminals 20, 21 are inserted into the printed wiring board 40 so as to be electrically connected, while tab terminal portions of the fixed contact terminals 27, 28 and the tab terminal portion 26*a* of the yoke 26 can be electrically connected to external equipment through a lead wire (not shown).

Figure 5:
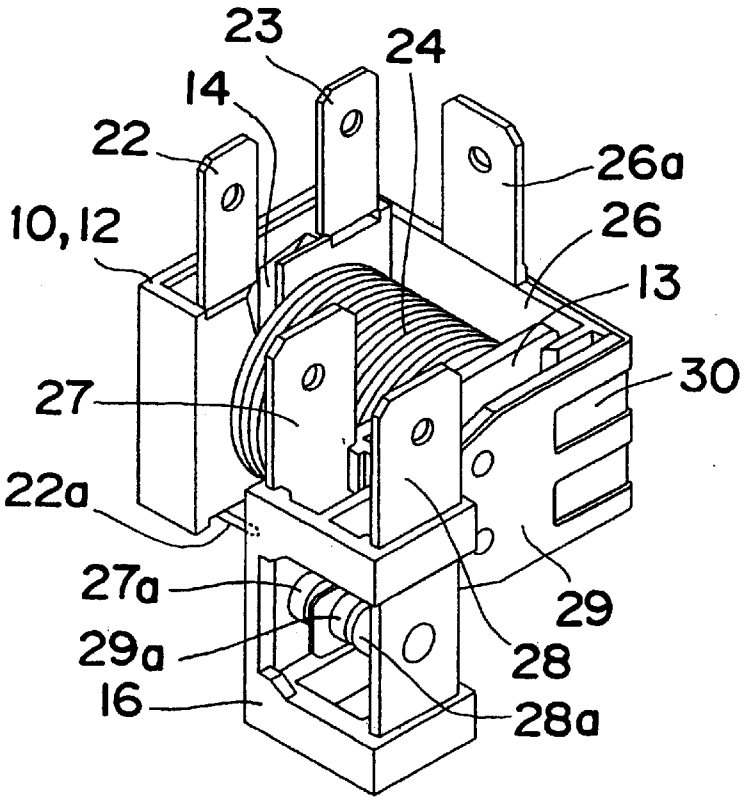
FIG. 5 is a perspective view showing another applied example of the embodiment according to the present invention.

FIG. 5 illustrates another applied example of the present embodiment. The basic constitution is almost the same as that of the above-mentioned applied example. The difference is that tabbed coil terminals 22, 23 are press-fitted into the coil terminal holes 12*a*, 12*b* of the flange 12 from the upper side.

Figure 6:
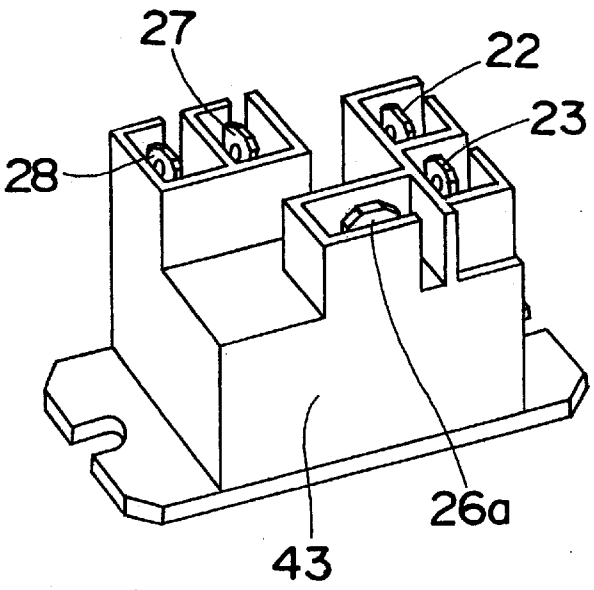
FIG. 6 is a schematic perspective view showing a connection method in the applied example shown in FIG. 5.

In this embodiment according to the present embodiment, for example, as shown in FIG. 6, the tab terminal portions of the coil terminals 22, 23, the tab terminal portions of the fixed contact terminals 27, 28 and the tab terminal portion 26*a* of the yoke 26 can be electrically connected to external appliance through a lead wire (not shown).

Therefore, according to the present embodiment, spools of the same shape can be used for various connection methods, which are convenient in use.

Further, press-fitting shaft portions of the tabbed coil terminals 22, 23 and their twining portions 22*a*, 23*a* (the twining portion 23*a* is not shown in FIG. 5) have the same sectional shape. Therefore, when the tabbed coil terminals 22, 23 are press-fitted into the coil terminal holes 12*a*, 12*b*, their twining portions 22*a*, 23*a* are protruded downward.

As shown in FIGS. 8 and 9, an inward surface of the flange 12 is formed with a pair of coil guide grooves 14, 15, which grooves are point symmetrical in relation to the central axis of the body 11. For this reason, even in the case where the tabbed coil terminals 22, 23 are press-fitted into the terminal holes 12*a*, 12*b* of the flange 12 so as to wind the coil 24 on the body 11 of the spool 10, the same spool 10 can be used. As a result, even in the case where terminals of different shapes are used, all that is required is to control only one type of spool formed by one type of mold. Accordingly, production cost can be reduced, and inventory control also becomes easy.

Further, since the spools 10 of the same shape can be used, a considerable labor of adjusting work is not required when winding coils on spools of different shapes by an automatic winding machine, thus there is an advantage of high production efficiency.

Furthermore, it is not necessary to mold spools of different types using two types of molds as in the prior art embodiment, resulting in small variations in the dimension accuracy of spools. For that reason, adjustment work in assembling a component such as the yoke 26 to the spool 10 becomes unnecessary, which has an advantage of high productivity.

What is claimed is:

1. A spool structure for an electromagnetic relay comprising a body, and flanges respectively formed on both end portions of the body, the one side flange being provided with at least two coil terminal holes that permit coil terminals to be press fitted and also permit their twining portions to be protruded, while the other side flange being integrally formed with a fixed contact terminal-use holding part;

wherein an inward surface of the one side flange is formed with at least two coil guide grooves for start-up of coil winding, which grooves are in point symmetrical with respect to the central axis of the body so that they are individually positioned between the coil terminal holes.

* * * * *